US006032453A

United States Patent [19]

Stahlecker

[11] Patent Number: 6,032,453

[45] Date of Patent: Mar. 7, 2000

[54] OPEN-END SPINNING ROTOR AND METHOD OF MAKING SAME

[75] Inventor: Fritz Stahlecker, Josef-Neidhart-Strasse 18, 73337 Bad Überkingen, Germany

[73] Assignees: Fritz Stahlecker; Hans Stahlecker, both of Germany

[21] Appl. No.: 09/157,957

[22] Filed: Sep. 22, 1998

[30] Foreign Application Priority Data

Oct. 2, 1997 [DE] Germany ..... 197 43 597

[51] Int. Cl.[7] ..... D01H 4/00

[52] U.S. Cl. ..... 57/414; 57/404

[58] Field of Search ..... 57/404, 414, 416

[56] References Cited

U.S. PATENT DOCUMENTS

| | | | |
|---|---|---|---|
| 3,439,487 | 4/1969 | Landwehrkamp et al. | 57/414 |
| 4,193,253 | 3/1980 | Herbert et al. | 57/58.89 |
| 4,358,922 | 11/1982 | Feldstein | 57/401 |
| 4,358,923 | 11/1982 | Feldstein | 57/401 |
| 4,547,407 | 10/1985 | Spencer | 427/367 |
| 4,662,170 | 5/1987 | Raasch | 57/416 |
| 4,866,927 | 9/1989 | Fetzer et al. | 57/414 |
| 4,928,477 | 5/1990 | Kalitzki et al. | 57/416 |
| 5,528,799 | 6/1996 | Bach et al. | 19/258 |

FOREIGN PATENT DOCUMENTS

| | | | |
|---|---|---|---|
| 4305626A1 | 8/1994 | Germany . | |
| 1389244 | 2/1975 | United Kingdom | 57/414 |

*Primary Examiner*—William Stryjewski
*Attorney, Agent, or Firm*—Evenson, McKeown, Edwards & Lenahan, P.L.L.C.

[57] ABSTRACT

The fiber sliding surface and the fiber collecting groove of an open-end spinning rotor are provided with hard particles embedded therein. After a certain length of operation time of the spinning rotor, the particles in the fiber collecting groove have a larger particle size than the particles in the fiber sliding surface. Thus it is ensured that the fiber collecting groove has a better "grip effect" relative to the fibers to be spun than the smoother fiber sliding surface.

24 Claims, 2 Drawing Sheets

OPEN-END SPINNING ROTOR AND METHOD OF MAKING SAME

BACKGROUND AND SUMMARY OF THE INVENTION

This application claims the priority of German application 197 43 597.1, filed Oct. 2, 1997 in Germany, the disclosure of which is expressly incorporated by reference herein.

The present invention relates to an open-end spinning rotor comprising a fiber sliding surface and a fiber collecting groove containing plated surfaces, in which hard particles of a certain size are embedded.

It is disclosed in German published patent application 43 05 626 that the fiber collecting groove relative to the fibers to be spun has a greater frictional resistance than the fiber sliding surface. This permits the fibers to slide sufficiently rapidly to the fiber collecting groove and thereafter, at the latest at the point of the fiber collecting groove, to take on the speed of the spinning rotor. All the surfaces of the spinning rotor are provided with a nickel-diamond plating, whereby the desired roughness in the fiber collecting groove is achieved in that individual diamond particles of a certain size project out from the plating. The fiber sliding surface in contrast is subsequently smoothed, such that a large proportion of the diamond grains are pulled out, whereby the fiber sliding surface loses its undesirable strong grip effect.

The disadvantage is that the fiber sliding surface is not sufficiently wear resistant anymore after the diamond particles have been pulled out.

It is an object of the present invention to plate an open-end spinning rotor of the above mentioned type in such a way that the fiber sliding surface as well as the fiber collecting groove are sufficiently protected against wear, and that the fiber collecting groove has a better grip effect relative to the fibers to be spun than the fiber sliding surface.

This object has been achieved in accordance with the present invention in that the plating is so configured that the particles embedded in the fiber collecting groove are larger than those embedded in the fiber sliding surface after a certain length of operation spinning time.

By means of the hard particles provided in the fiber collecting groove as well as the fiber sliding surface, a sufficiently high wear resistance of the open-end spinning rotor is achieved. Because the particles belonging to the fiber collecting groove are larger than the particles belonging to the fiber sliding surface, the fiber collecting groove has the greater grip effect relative to the fibers to be spun in comparison to the fiber sliding surface.

In an embodiment of the present invention it is provided that the plated surfaces originally comprise a first plating containing particles of a larger size and a second plating on top of the first containing particles of a smaller size.

The latter applied plating containing the smaller sized particles is sufficiently smooth and is suitable for a fiber sliding surface, and is also sufficiently wear resistant, at least on the fiber sliding surface. The fibers can thus slide on the fiber sliding surface into the fiber collecting groove, without an undesirable friction wear occurring on the fiber sliding surface. Using the correct choice of particle size, the grip effect of the fiber collecting groove is at first sufficient; however, the wear is greater in this area of the open-end spinning rotor. The reason for this is that the fibers fed into the fiber collecting groove—in contrast to the fiber sliding surface—receive an additional twist, as the yarn twist lasts right into the fiber collecting groove. This results in a faster friction wear of the latterly applied plating in the fiber collecting groove. Thus after only a few hours operation, the underlying plating containing the larger hard particles is exposed. The larger-sized particles ensure, however, that the wear on the fiber collecting groove is significantly slowed down. At the same time, the trip effect of the fiber collecting groove increases, so that the yarn quality does not worsen overall. After a certain operation time, a fiber collecting groove with more grip effect than the fiber sliding surface is relatively quickly achieved, as the upper plating containing the smaller particles is worn off and the underlying plating containing the larger particles is exposed. Thus after a short running-in time of the open-end spinning rotor, the ideal situation is reached whereby the fiber sliding surface as well as the fiber collecting groove is sufficiently wear resistant, the fiber collecting groove nevertheless having, in relation to the fibers to be spun, the stronger grip effect in comparison to the fiber sliding surface.

Practical experience has shown that it is favorable when the first as well as the second plating are each a nickel-diamond plating. Nickel-diamond plates create excellent spinning conditions and can be adapted, with regard to the particle size, to the desired requirements.

It has proven to be advantageous when the larger particle size measures circa between 2.5 and 4 $\mu$m (mean diameter of the particle grain size), and the smaller particle size measures circa 1.5 to 2 $\mu$m. This is a good compromise as regards yarn quality and wear protection.

In order that, on the one hand the open-end spinning rotor achieves adequate endurance, and on the other that the upper plating in the fiber collecting groove is worn down as quickly as possible, the first plating should have a thickness of approximately 20 to 30 $\mu$m and the second plating a thickness of approximately 10 to 15 $\mu$m.

It is also advantageous when the percentage of particles in the first plating is higher than the percentage of particles in the second plating. Thus the different grip effect in the fiber collecting groove and in the fiber sliding surface is achieved not only by means of the different-sized particles, but also by means of the different percentages of particles in the plates.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
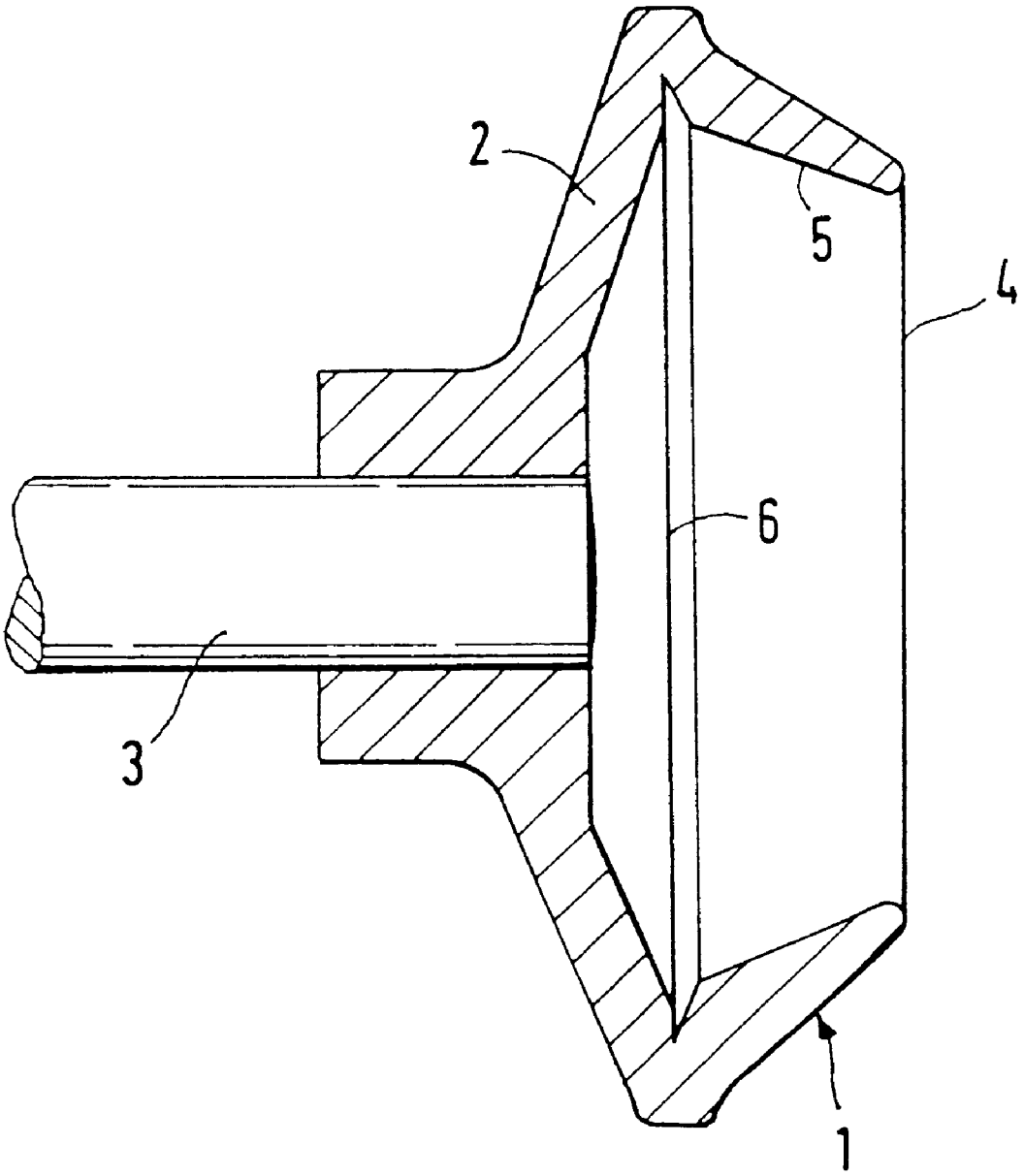
FIG. 1 is a longitudinal section of an open-end spinning rotor constructed according to a preferred embodiment of the present invention.

The open-end spinning rotor 1 shown in FIG. 1 comprises In a known way a rotor cup 2 and a shaft 3 tightly coupled thereto. The open front side 4 of the rotor cup 3 faces the operator's side of the open-end spinning aggregate and is closed during operation by means of a cover (not shown).

During operation, fibers to be spun are fed by means of a fiber feed channel (not shown) to a fiber sliding surface 5 of the rotor cup 2. On this fiber sliding surface 5, the fibers slide under the action of centrifugal forces to a fiber collecting groove 6, which has on the inside of the rotor cup 2 the largest diameter.

In order that fibers reliably reach the fiber collecting groove 6 even in the case of relatively steep fiber sliding surfaces 5, the fiber sliding surface 5 should be designed to be sufficiently smooth. In the fiber collecting groove 6, in contrast, the fibers should take on the speed of the rotor cup 2 with as little slippage as possible. For this reason, the fiber collecting groove 6 has a sufficient grip effect relative to the fibers.

The desirable frictional ratios at the fiber sliding surface 5 and in the fiber collecting groove 6 are achieved in that the surface of the fiber collecting groove 6 and the fiber sliding surface 5 are provided with hard particles of differing sizes, at least after a certain running-in time of the open-end spinning rotor 1 during operation.

Figure 2:
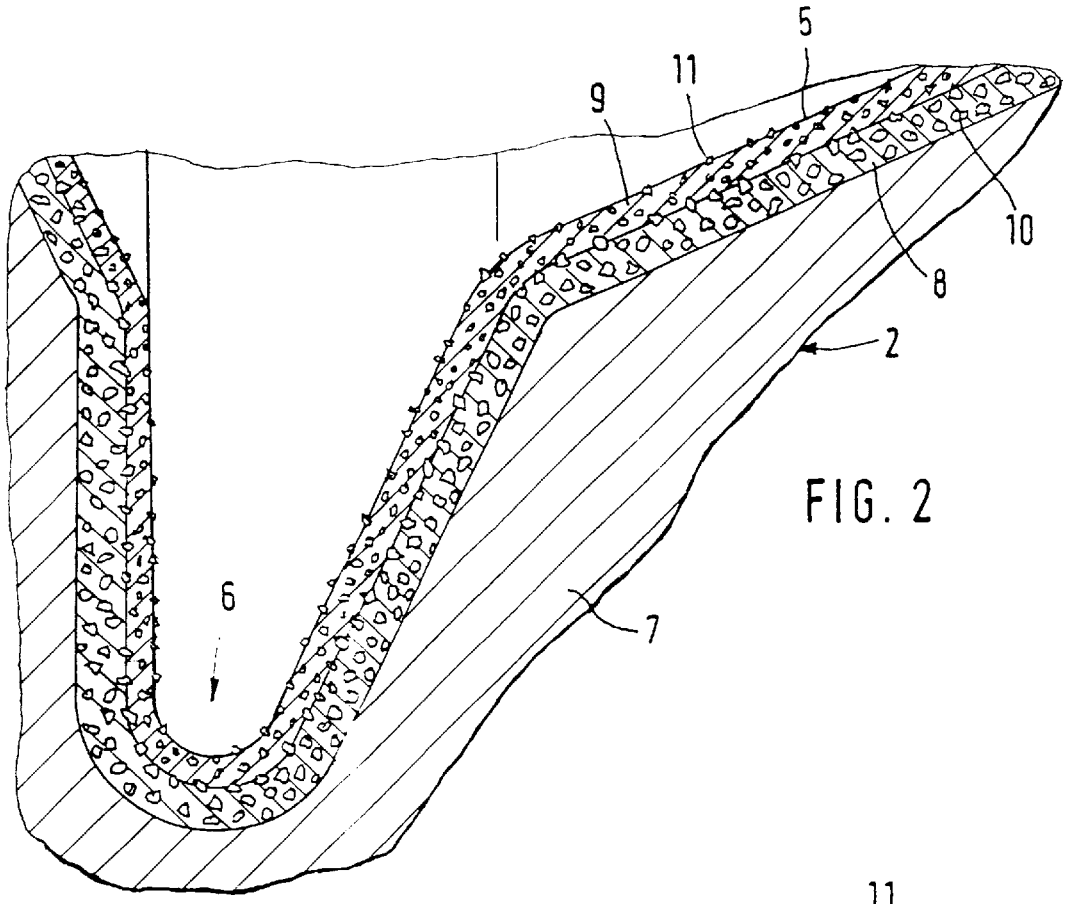
FIG. 2 is a greatly enlarged part view of FIG. 1 in the area of the fiber sliding surface and the fiber collecting groove.
Figure 3:
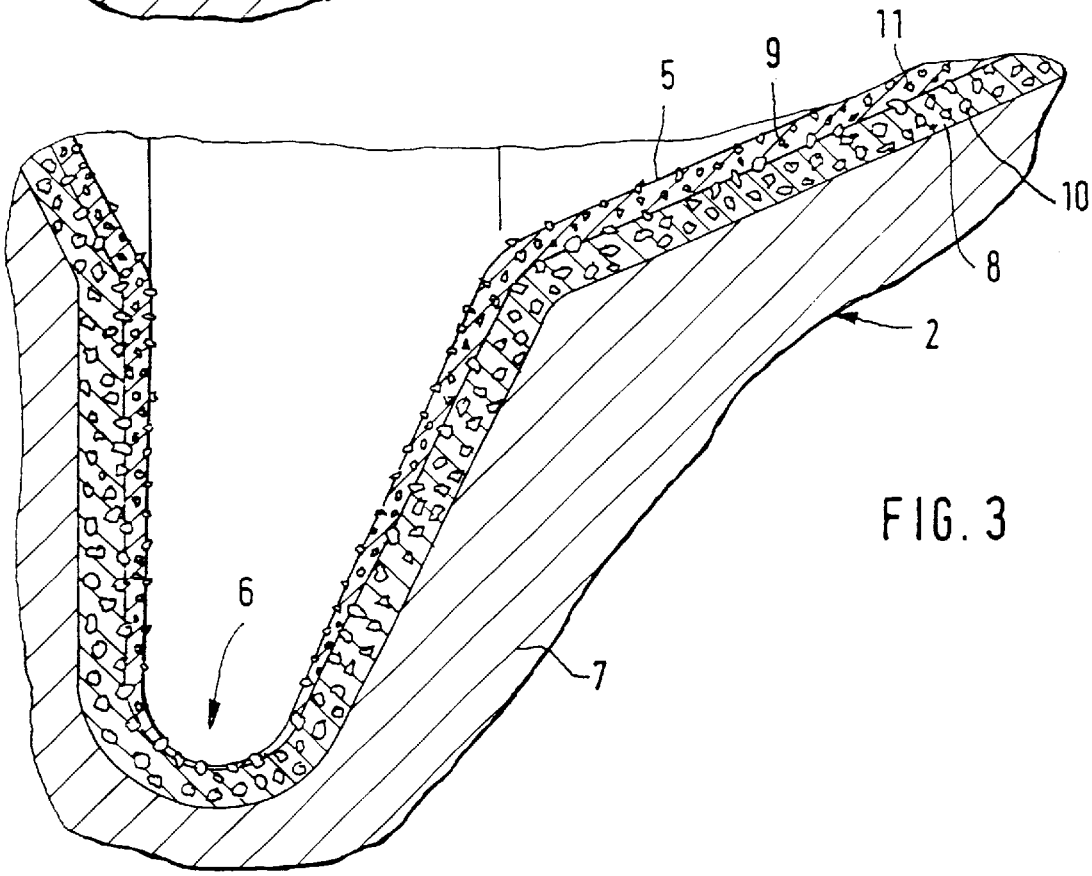
FIG. 3 is a view of FIG. 2 after a certain operation time of the open-end spinning rotor.

With reference to FIGS. 2 and 3, obtaining the different-sized particles after a certain length of operation time is explained below.

The base body 7 of the rotor cup 2 consists of a high-strength steel, on the surface of which a first plating 8 and thereupon a second plating 9 is applied. The latter, second plating 9 is the one which directly comes into contact with the fibers to be spun. Both plates 8 and 9 extend inside and out over the entire rotor cup 2 and provide thus in addition to wear protection also an adequate corrosion protection. Furthermore, the second plating 9 must be so designed that good spinning conditions and yarn quality are attainable.

In the first plating 8, hard particles 10 of a larger size are embedded and in the second plating 9 hard particles 11 of a smaller size are embedded.

The size of the hard particles 10 and 11 as well as their percentage in the two plates 8 and 9 is selected in such a way that in the area of the fiber sliding surface 5 the second plating 9 is sufficiently wear-resistant as well as sufficiently smooth relative to the fibers to be spun. At the same time, these values are chosen in order that in the fiber collecting groove 6 the second plating 9 is already worn down after relatively few operational hours to such a degree that the underlying first plating 8 containing the hard particles 10 of a larger size embedded therein are to a great extent exposed. Thus the fiber collecting groove 6 attains a greater grip effect relative to the fibers after a certain running-in time of the open-end spinning rotor 1, and furthermore the fiber collecting groove 6 is more wear-resistant, so that a further wearing down of the exposed first plating 8 does not take place, or at least is significantly slowed down.

On the fiber sliding surface 5 in contrast, the fibers, as before, only come into contact with the second plating 9 and the smaller-sized particles 11.

Different platings 8 and 9 are contemplated, and the hard particles 10 and 11 may be quartz or corundum. It has proven to be favorable according to especially preferred embodiments when the first plating 8 and the second plating 9 are each a nickel-diamond plating, containing, however, the above mentioned different particle sizes. The larger grain sizes measure hereby between 2.5 and 4 $\mu$m, and the smaller-sized grains 1.5 to 2 $\mu$m. The thickness of the first plating 8 is selected for the purpose of the present invention at between 20 and 30 $\mu$m and the thickness of the second plating 9 at advantageously between 10 and 15 $\mu$m. The percentage of the hard particles 10 in the first plating 8 should be larger than the percentage of the hard particles 11 in the second plating 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An open-end spinning rotor comprising a fiber sliding surface and a fiber collecting groove containing plated surfaces, in which hard particles of a certain grain size are embedded, wherein the plated surfaces originally comprise a first plating having particles of a larger particle size and a second, overlying plating having particles of a smaller particle size.

2. An open-end spinning rotor according to claim 1, wherein the first plating as well as the second plating are nickel-diamond platings with diamond particles embedded in the nickel platings.

3. An open-end spinning rotor according to claim 2, wherein the larger particle size measures between circa 2.5 and 4 $\mu$m, and the smaller particle size measures between circa 1.5 and 2 $\mu$m.

4. An open-end spinning rotor according to claim 2, wherein the first plating has a thickness of between 20 to 30 $\mu$m and the second plating has a thickness of between 10 and 15 $\mu$m.

5. An open-end spinning rotor according to claim 2, wherein the percentage of the particles in the first plating is larger than the percentage of particles in the second plating.

6. An open-end spinning rotor according to claim 1, wherein the larger particle size measures between circa 2.5 and 4 $\mu$m, and the smaller particle size measures between circa 1.5 and 2 $\mu$m.

7. An open-end spinning rotor according to claim 6, wherein the first plating has a thickness of between 20 to 30 $\mu$m and the second plating has a thickness of between 10 and 15 $\mu$m.

8. An open-end spinning rotor according to claim 7, wherein the percentage of the particles in the first plating is larger than the percentage of particles in the second plating.

9. An open-end spinning rotor according to claim 6, wherein the percentage of the particles in the first plating is larger than the percentage of particles in the second plating.

10. An open-end spinning rotor according to claim 1, wherein the first plating has a thickness of between 20 to 30 $\mu$m and the second plating has a thickness of between 10 and 15 $\mu$m.

11. An open-end spinning rotor according to claim 10, wherein the percentage of the particles in the first plating is larger than the percentage of particles in the second plating.

12. An open-end spinning rotor according to claim 1, wherein the percentage of the particles in the first plating is larger than the percentage of particles in the second plating.

13. An open-end spinning rotor according to claim 1, wherein, in response to in use spinning operations with different wearing action on the fiber sliding surface and fiber collecting groove, the particles protruding in the fiber collection groove have a larger grain size than the particles protruding in the fiber sliding surface.

14. A method of making an open-end spinning rotor cup, comprising:

providing a rotor cup which has internal annular surfaces for forming a fiber sliding surface and a fiber collecting groove, placing a first plating layer on said internal annular surfaces, which first plating layer includes embedded large wear resistant particles, and placing a second plating layer on said first plating layer, which second plating layer includes embedded smaller wear resistant particles.

15. A method according to claim 14, wherein, in response to in use spinning operations with different wearing action on the fiber sliding surface and fiber collecting groove, the particles protruding in the fiber collection groove have a larger grain size than the particles protruding in the fiber sliding surface.

16. A method according to claim 15, wherein the first plating layer as well as the second plating layer are nickel-diamond platings with diamond particles embedded in the nickel platings.

17. A method according to claim 16, wherein the first plating layer as well as the second plating layer are nickel-diamond platings with diamond particles embedded in the nickel platings.

18. A method according to claim 17, wherein the first plating layer has a thickness of between 20 to 30 $\mu$m and the second plating layer has a thickness of between 10 and 15 $\mu$m.

19. A method according to claim 18, wherein the percentage of the particles in the first plating layer is larger than the percentage of particles in the second plating layer.

20. A method according to claim 17, wherein the percentage of the particles in the first plating layer is larger than the percentage of particles in the second plating layer.

21. A method according to claim 16, wherein the percentage of the particles in the first plating layer is larger than the percentage of particles in the second plating.

22. A method according to claim 15, wherein the first plating layer as well as the second plating layer are nickel-diamond platings with diamond particles embedded in the nickel platings.

23. A method according to claim 15, wherein the first plating layer has a thickness of between 20 to 30 $\mu$m and the second plating layer has a thickness of between 10 and 15 $\mu$m.

24. A method according to claim 15, wherein the percentage of the particles in the first plating layer is larger than the percentage of particles in the second plating.

* * * * *